US009215528B2

(12) United States Patent
Jia et al.

(10) Patent No.: US 9,215,528 B2
(45) Date of Patent: Dec. 15, 2015

(54) FLAT PANEL ELECTRONIC DEVICE AND AUDIO PLAYING APPARATUS THEREOF

(71) Applicant: Nvidia Corporation, Santa Clara, CA (US)

(72) Inventors: Zhen Jia, Shenzhen (CN); Jing Guo, Shenzhen (CN); Huiying Chin, Shenzhen (CN); Weibin He, Shenzhen (CN)

(73) Assignee: NVIDIA CORPORATION, Santa Clara, CA (US)

( * ) Notice: Subject to any disclaimer, the term of this patent is extended or adjusted under 35 U.S.C. 154(b) by 333 days.

(21) Appl. No.: 13/864,422

(22) Filed: Apr. 17, 2013

(65) Prior Publication Data

US 2014/0219482 A1 Aug. 7, 2014

(30) Foreign Application Priority Data

Feb. 6, 2013 (CN) ..... 2013 1 0048038

(51) Int. Cl.
*H04R 5/02* (2006.01)
*H04R 5/04* (2006.01)

(52) U.S. Cl.
CPC .. *H04R 5/02* (2013.01); *H04R 5/04* (2013.01); *H04R 2420/01* (2013.01); *H04R 2499/15* (2013.01)

(58) Field of Classification Search
CPC .. H04R 2420/01; H04R 2499/15; H04R 5/02; H04R 5/04
USPC ..... 381/2, 18, 19, 87, 107, 182, 306, 323, 381/332, 333, 335, 386–388, 304; 700/94; 348/738, 333.13
See application file for complete search history.

(56) References Cited

U.S. PATENT DOCUMENTS

| | | | | |
|---|---|---|---|---|
| 2001/0011993 | A1* | 8/2001 | Saarinen | 345/156 |
| 2003/0156075 | A1* | 8/2003 | Motoyama et al. | 345/1.3 |
| 2005/0047624 | A1* | 3/2005 | Kleen | 381/388 |
| 2006/0044419 | A1* | 3/2006 | Ozawa | 348/231.99 |
| 2006/0161278 | A1* | 7/2006 | Maeda et al. | 700/94 |
| 2006/0227985 | A1* | 10/2006 | Kawanami | 381/306 |

(Continued)

FOREIGN PATENT DOCUMENTS

| | | | |
|---|---|---|---|
| CN | 100524196 | C | 8/2009 |
| CN | 101776945 | A | 7/2010 |

(Continued)

OTHER PUBLICATIONS

Translation of German Examination Report dated Jun. 11, 2014, Applicant: Nvidia Corporation, 12 pages.

*Primary Examiner* — Vivian Chin
*Assistant Examiner* — Friedrich W Fahnert

(57) ABSTRACT

A flat panel electronic device and an audio playing apparatus thereof are provided. The audio playing apparatus comprises an audio generator, a plurality of speakers, a sensor and a controller. The audio generator is operable to generate a left channel audio and a right channel audio. The plurality of speakers are configured such that at least one pair of speakers is symmetrically disposed at a left side and a right side of the flat panel electronic device no matter how the flat panel electronic device is placed. The sensor is operable to detect a placed state of the flat panel electronic device in the installed state. The controller is operable to receive a detecting signal from the sensor so as to control the at least one pair of speakers to play the left channel audio and the right channel audio correspondingly according to the placed state of the flat panel electronic device.

20 Claims, 8 Drawing Sheets

(56) References Cited

U.S. PATENT DOCUMENTS

| | | | | |
|---|---|---|---|---|
| 2007/0047187 | A1* | 3/2007 | Kumano et al. | 361/681 |
| 2010/0008523 | A1 | 1/2010 | Demuynck et al. | |
| 2011/0316768 | A1* | 12/2011 | McRae | 345/156 |
| 2013/0077803 | A1* | 3/2013 | Konno et al. | 381/107 |
| 2013/0321714 | A1* | 12/2013 | Kobayashi et al. | 348/738 |

FOREIGN PATENT DOCUMENTS

| | | | |
|---|---|---|---|
| DE | 102011052098 | B3 | 1/2013 |
| EP | 1124175 | A2 | 8/2001 |
| EP | 1670226 | A1 | 6/2006 |
| TW | 200532581 | A | 10/2005 |
| WO | 9934643 | A1 | 7/1999 |

* cited by examiner

FLAT PANEL ELECTRONIC DEVICE AND AUDIO PLAYING APPARATUS THEREOF

CROSS-REFERENCE TO RELATED APPLICATION

This application claims priority based on Chinese Patent Application No. 201310048038.1, filed by Jia, et al., on Feb. 6, 2013, commonly assigned with this application and incorporated herein by reference.

TECHNICAL FIELD

This application relates generally to the field of electronics and more particularly to an audio playing apparatus and a flat panel electronic device having the audio playing apparatus.

BACKGROUND

Flat panel electronic devices, including tablet PCs, flat panel mobile phones, etc., are widely used as audio playing apparatuses because of advantages, such as portable characteristic, fashion and multifunction. In the prior art, a pair of speakers which are disposed at the left side and right side of the flat panel electronic device are usually used for playing the left channel audio and the right channel audio corresponding to the left ear and the right ear respectively, so that a user can experience the stereo effect. However, in use, the flat panel electronic device is often be rotated by the user according to actual requirement. The rotations of the flat panel electronic device result in changes of the positions of the speakers. For example, the initial left-and-right arrangement of the speakers changes into the top-and-bottom arrangement as the flat panel electronic device is rotated by 90° or 270°. The audio enjoyment of the user is inevitably affected when the left channel audio and the right channel audio are played from the top and the bottom of the flat panel electronic device, respectively. Even though, the rotation of 180° of the flat panel electronic device results that the left channel audio and the right channel audio are played from the right side and the left side of the flat panel electronic device, respectively, thus it will also affect the audio enjoyment of the user.

SUMMARY

It is realized herein that a need exists for a flat panel electronic device and an audio playing apparatus capable of addressing at least some of the problems described in the Background above.

To solve the above problem, in one embodiment, an audio playing apparatus for a flat panel electronic device is disclosed. The audio playing apparatus includes an audio generator operable to generate a left channel audio and a right channel audio. The audio playing apparatus also includes a plurality of speakers configured such that at least one pair of speakers of the plurality of speakers is symmetrically disposed at a left side and a right side of the flat panel electronic device in an installed state that the audio playing apparatus is installed to the flat panel electronic device, respectively, no matter how the flat panel electronic device is placed. The audio playing apparatus further includes a sensor operable to detect a placed state of the flat panel electronic device in the installed state. Finally, the audio playing apparatus further includes a controller operable to receive a detecting signal from the sensor so as to control the at least one pair of speakers to play the left channel audio and the right channel audio correspondingly according to the placed state of the flat panel electronic device.

In one embodiment, the plurality of the speakers are configured such that multi-pairs of speakers of the plurality of speakers are symmetrically disposed at the left side and the right side of the flat panel electronic device in the installed state, respectively, no matter how the flat panel electronic device is placed.

In one embodiment, the audio playing apparatus has a power saving mode, and wherein the controller is operable to control only one pair of speakers of the multi-pairs of speakers to play the left channel audio and the right channel audio correspondingly under the power saving mode.

In one embodiment, the multi-pairs of speakers include a first pair of speakers and a second pair of speakers, wherein the left channel audio includes a first left channel audio and a second left channel audio and the right channel audio includes a first right channel audio and a second right channel audio, and wherein the first pair of speakers are used for playing the first left channel audio and the first right channel audio correspondingly and the second pair of speakers are used for playing the second left channel audio and the second right channel audio correspondingly.

In one embodiment, the audio playing apparatus includes four speakers which are disposed at four corners of the flat panel electronic device in the installed state, respectively.

In one embodiment, the controller includes a first multiplexer, a second multiplexer and a control unit. Wherein an input of the first multiplexer and an input of the second multiplexer receive the left channel audio and the right channel audio respectively and outputs of the first multiplexer and outputs of the second multiplexer are connected to each of the plurality of the speakers. The control unit is operable to control the first multiplexer and the second multiplexer according to the detecting signal.

In one embodiment, the controller further includes a GPIO (general purpose input and output) through which the control unit controls the first multiplexer and the second multiplexer.

In one embodiment, the first multiplexer and the second multiplexer are integrated in the audio generator.

In one embodiment, the audio playing apparatus includes three speakers which are disposed at three corners of the flat panel electronic device in the installed state, respectively.

In one embodiment, the sensor is selected from the group including a 9-axis sensor, a 6-axis sensor, a gravity sensor, a magnetic sensor and a gyro.

According to another aspect, a flat panel electronic device is further provided. The flat panel electronic device has an audio playing apparatus. The audio playing apparatus includes an audio generator operable to generate a left channel audio and a right channel audio. The audio playing apparatus also includes a plurality of speakers configured such that at least one pair of speakers of the plurality of speakers is symmetrically disposed at a left side and a right side of the flat panel electronic device respectively, no matter how the flat panel electronic device is placed. The audio playing apparatus further includes a sensor operable to detect a placed state of the flat panel electronic device. Finally, the audio playing apparatus further includes a controller operable to receive a detecting signal from the sensor so as to control the at least one pair of speakers to play the left channel audio and the right channel audio correspondingly according to the placed state of the flat panel electronic device In one embodiment, the plurality of the speakers are configured such that multi-pairs of speakers of the plurality of speakers are symmetrically disposed at the left side and the right side of the flat panel electronic device respectively, no matter how the flat panel electronic device is placed.

In one embodiment, the audio playing apparatus has a power saving mode, and wherein the controller is operable to control only one pair of speakers of the multi-pairs of speakers to play the left channel audio and the right channel audio correspondingly under the power saving mode.

In one embodiment, the multi-pairs of speakers include a first pair of speakers and a second pair of speakers, wherein the left channel audio includes a first left channel audio and a second left channel audio and the right channel audio includes a first right channel audio and a second right channel audio, and wherein the first pair of speakers are used for playing the first left channel audio and the first right channel audio correspondingly and the second pair of speakers are used for playing the second left channel audio and the second right channel audio correspondingly.

In one embodiment, the audio playing apparatus includes four speakers which are disposed at four corners of the flat panel electronic device, respectively.

In one embodiment, the controller includes a first multiplexer, a second multiplexer and a control unit. Wherein an input of the first multiplexer and an input of the second multiplexer receive the left channel audio and the right channel audio respectively and outputs of the first multiplexer and outputs of the second multiplexer are connected to each of the plurality of the speakers. The control unit is operable to control the first multiplexer and the second multiplexer according to the detecting signal.

In one embodiment, the controller further includes a GPIO through which the control unit controls the first multiplexer and the second multiplexer.

In one embodiment, the first multiplexer and the second multiplexer are integrated in the audio generator.

In one embodiment, the audio playing apparatus includes three speakers which are disposed at three corners of the flat panel electronic device respectively.

In one embodiment, the sensor is selected from the group including a 9-axis sensor, a 6-axis sensor, a gravity sensor, a magnetic sensor and a gyro.

Various embodiments of the audio playing apparatus are able to play the left channel audio and the right channel audio corresponding to the left ear and the right ear respectively, according to the current placed state of the flat panel electronic device.

BRIEF DESCRIPTION

Reference is now made to the following descriptions taken in conjunction with the accompanying drawings, in which.

DETAILED DESCRIPTION

In the following discussion, details are presented so as to provide a more thorough understanding of the invention. However, the invention may be implemented without one or more of these details as would be apparent to one of skill in the pertinent art. Certain examples are illustrated without elaborate discussion of technical features that would be within the purview of one of skill in the pertinent art so as to avoid confusion.

Figure 1:
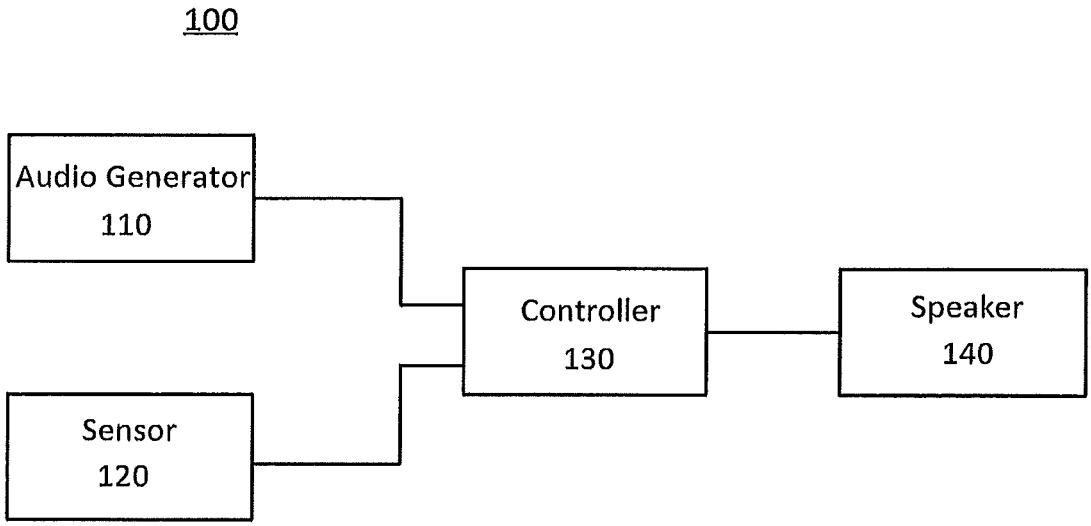
FIG. 1 is a schematic block diagram of one embodiment of an audio playing apparatus.

According to one aspect, an audio playing apparatus for a flat panel electronic device (hereinafter referred to as the audio playing apparatus) is provided. To understand the audio playing apparatus integrally, the audio playing apparatus is described in combination with FIGS. 1-5 firstly. FIG. 1 is a schematic block diagram of the audio playing apparatus in accordance with one embodiment. As shown in FIG. 1, the audio playing apparatus 100 includes an audio generator 110, a sensor 120, a controller 130 and a plurality of speakers 140.

The audio generator can be any device which is able to generate the left channel audio and the right channel audio. The audio generator includes but is not limited to an Audio CodeC. In one embodiment, as an audio generator 110, the Audio CodeC may process the original audio signals, such as analog-to-digital conversion, digital signal processing and digital-to analog conversion, so as to generate the left channel audio and the right channel audio.

The plurality of speakers 140 are configured such that at least one pair of speakers of the plurality of speakers 140 is symmetrically disposed at a left side and a right side of the flat panel electronic device 150 in an installed state that the audio playing apparatus 100 is installed to the flat panel electronic device 150, respectively, no matter how the flat panel electronic device 150 is placed.

Figure 2A:
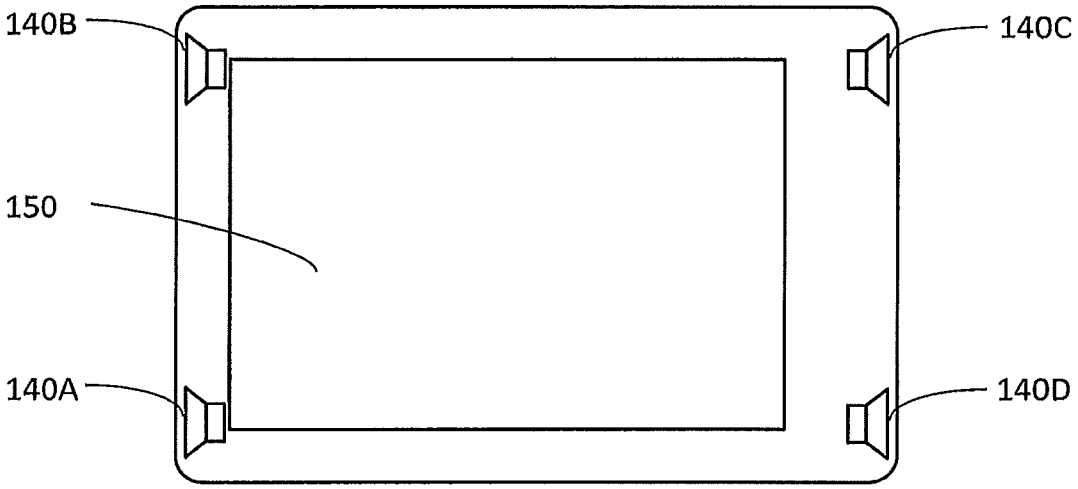
FIG. 2A is a schematic view of one embodiment of a flat panel electronic device.
Figure 2B:
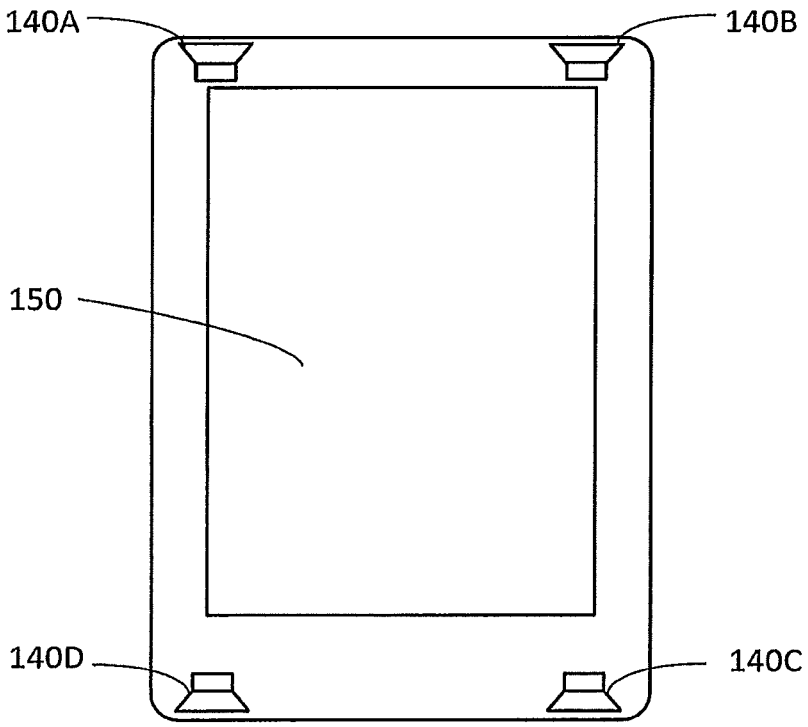
FIG. 2B is a schematic view of the flat panel electronic device shown in FIG. 2A rotated by 90° in a clockwise direction.
Figure 2C:
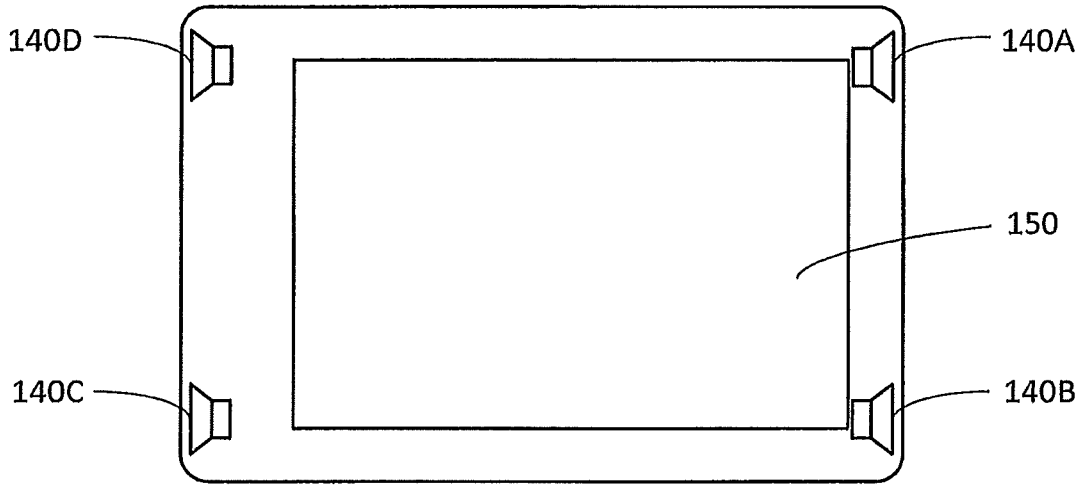
FIG. 2C is a schematic view of the flat panel electronic device shown in FIG. 2A rotated by 180° in a clockwise direction.
Figure 2D:
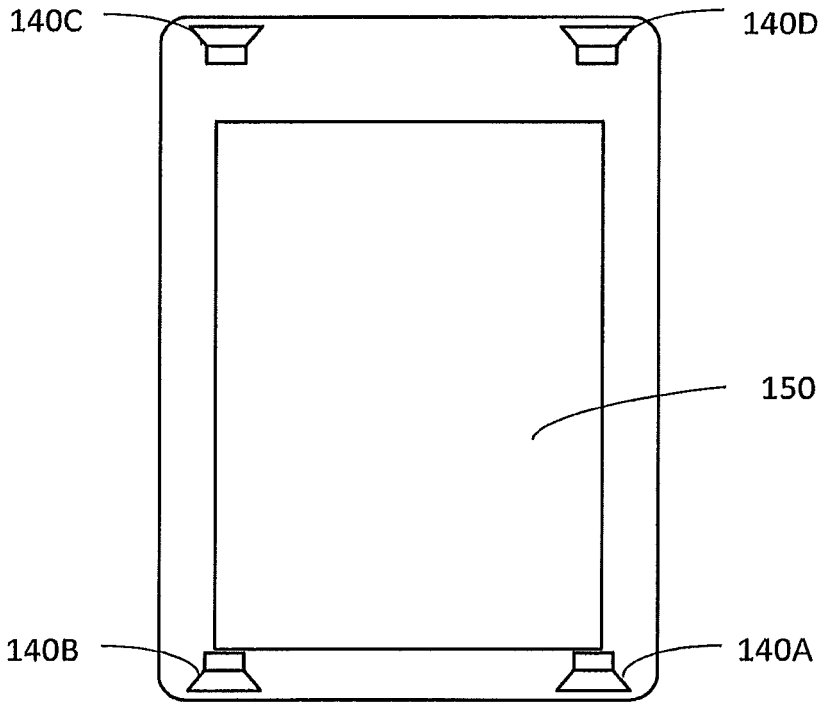
FIG. 2D is a schematic view of the flat panel electronic device shown in FIG. 2A rotated by 270° in a clockwise direction.
Figure 3:
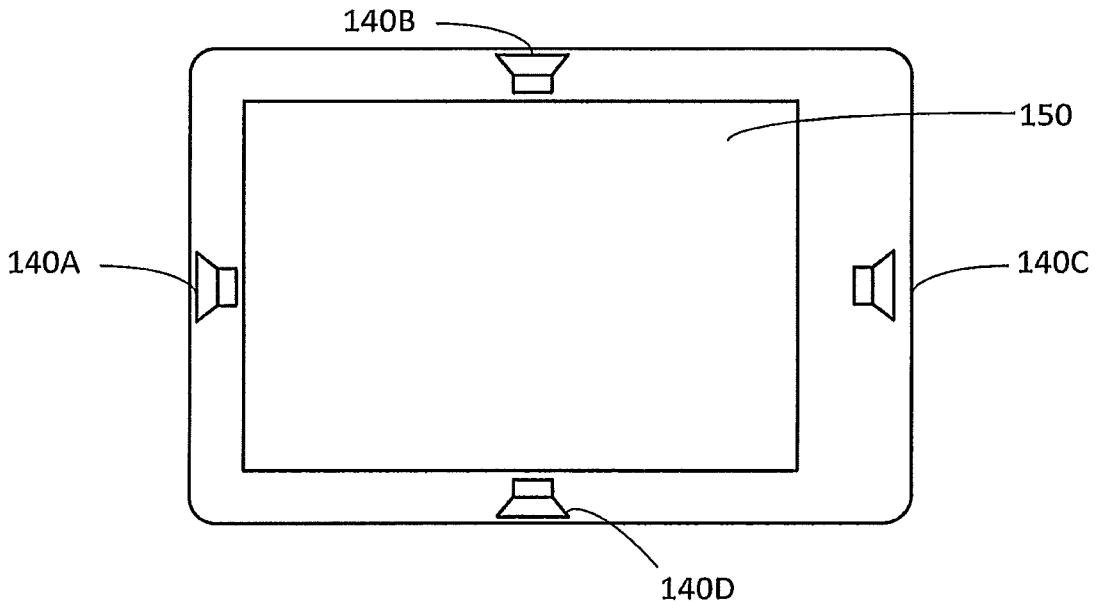
FIG. 3 is a schematic view of another embodiment of a flat panel electronic device.

In one embodiment, as shown in FIGS. 2A-2D, the flat panel electronic device 150 includes four speakers 140A, 140B, 140C and 140D. As shown in FIG. 2A, a pair of speakers 140A and 140D are symmetrically disposed at the left side and the right side of the flat panel electronic device 150 respectively, and the other pair of speakers 140B and 140C are also symmetrically disposed at the left side and the right side of the flat panel electronic device 150 respectively, but the speakers 140A and 140D are at different positions from the speakers 140B and 140C. In one embodiment, the speakers 140A and 140B may be disposed at the lower end and upper end of the left side of the flat panel electronic device 150 respectively, and the speakers 140C and 140D can be disposed at the corresponding positions of the right side of the flat panel electronic device 150. In one embodiment, the speakers 140A and 140B are disposed at the middle part of the left side of the flat panel electronic device 150, and the speakers 140C and 140D are disposed at the corresponding positions of the right side of the flat panel electronic device 150. When the flat panel electronic device 150 is rotated by 90° in a clockwise direction, the flat panel electronic device 150 is placed as shown in FIG. 2B. The speakers 140A and 140D are disposed at the left side of the flat panel electronic device 150, and the speakers 140B and 140C are disposed at the right side of the flat panel electronic device 150. When the flat panel electronic device 150 is rotated by 180° in a clockwise direction, the flat panel electronic device 150 is placed as shown in FIG. 2C. The speakers 140C and the speakers 140D are disposed at the left side of the flat panel electronic device 150, and the speakers 140A and 140B are disposed at the right side of the flat panel electronic device 150. When the flat panel electronic device 150 is rotated by 270° in a clockwise direction, the flat panel electronic device 150 is placed as shown in FIG. 2D. The speakers 140B and 140C are disposed at the left side of the flat panel electronic device 150, and the speakers 140A and 140D are disposed at the right side of the flat panel electronic device 150. The "left side" and the "right side" mentioned above are intended to describe the relative position relations of the plurality of speakers in the flat panel electronic device 150, which do not only include the left side edge and the right side edge of the flat panel electronic device 150. In this arrangement, at least one pair of speakers of the speakers 140A, 140B, 140C and 140D may be symmetrically disposed at the left side and the right side of the flat panel electronic device 150 respectively, no matter how the flat panel electronic device 150 is placed.

In one embodiment, the flat panel electronic device 150 includes four speakers 140A, 140B, 140C and 140D. These four speakers 140A, 140B, 140C and 140D may be arranged in the way shown in FIG. 3. One pair of the four speakers 140A, 140B, 140C and 140D is symmetrically disposed at the top and bottom of the flat panel electronic device 150 in the placed state shown in FIG. 3. As an example, the speaker 140B and 140D are symmetrically disposed at the top and the bottom of the flat panel electronic device 150, respectively. The other pair of the four speakers 140A, 140B, 140C and 140D, i.e. the speakers 140A and 140C, is symmetrically disposed at the left side and right side of the flat panel electronic device 150, respectively. When the flat panel electronic device 150 is rotated by 90°, 180° and 270° in a clockwise direction, at least one pair of speakers is able to be disposed at the left side and the right side of the flat panel electronic device 150.

Figure 4:
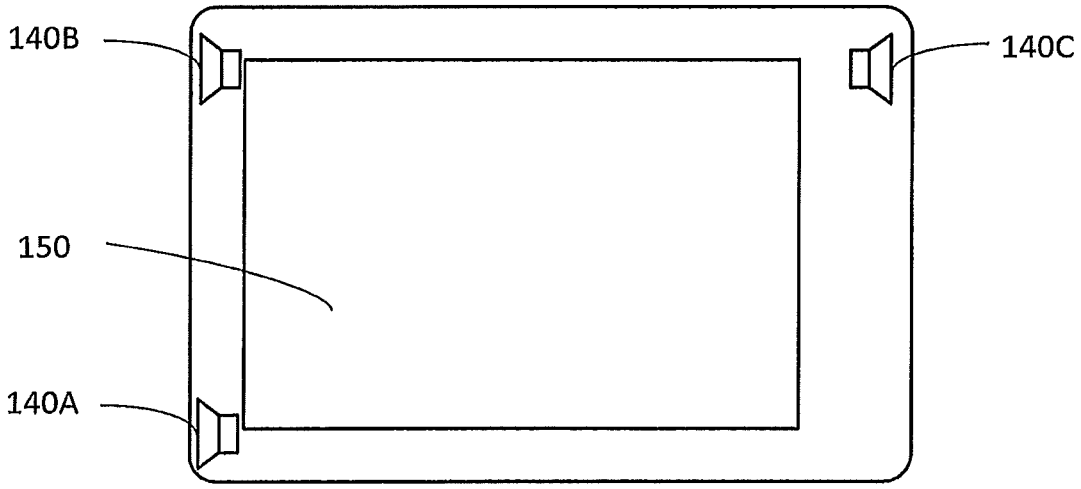
FIG. 4 is a schematic view of yet another embodiment of a flat panel electronic device.
Figure 5:
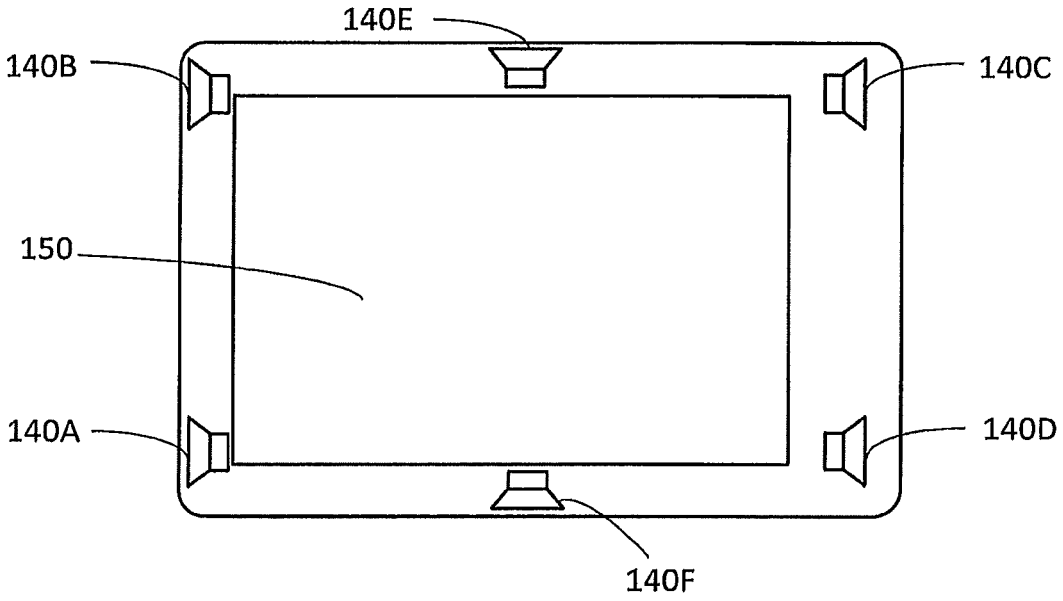
FIG. 5 is a schematic view of still another embodiment of a flat panel electronic device.

In another embodiment, the flat panel electronic device 150 may include three speakers 140A, 140B and 140C, as shown in FIG. 4. The three speakers 140A, 140B and 140C may be disposed at three corners of the flat panel electronic device 150. This arrangement can fulfill the purpose mentioned above. Furthermore, in other embodiments, more than four speakers, for example, five, six or seven speakers, etc., may be provided. As an example, the arrangement shown in FIG. 5 may be adopted when the flat panel electronic device 150 includes six speakers 140A, 140B, 140C, 140D, 140E and 140F.

The numbers and the arrangements of the speakers mentioned above are provided for illustration only. In practice, those skilled in the art can arrange the plurality of the speakers suitably, in view of various aspects, such as the actual situation and cost, etc.

The sensor 120 is operable to detect the placed state of the flat panel electronic device 150 in the installed state that the audio playing apparatus 100 is installed to the flat panel electronic device 150. Different users always place the flat panel electronic device 150 differently according to actual requirements and/or their personal habits in use, for example, as shown in FIGS. 2A-2D. The different placed states cause the positions of the speakers 140A, 140B, 140C and 140D to change, as mentioned above. Therefore, a sensor, which is able to detect the placed states of the flat panel electronic device 150 in real time, can be provided to the audio playing apparatus 100. As an example, the sensor may be selected from the group including a 9-axis sensor, a 6-axis sensor, a gravity sensor, a magnetic sensor and a gyro. These sensors substantially belong to the standard configuration of the flat panel electronic device in the prior art, and therefore, the cost can be reduced by using the component(s) existed in the flat panel electronic device as a part of the audio playing apparatus 100.

The controller 130 receives a detecting signal from the sensor 120 so as to control the at least one pair of speakers 140 to play the left channel audio and the right channel audio correspondingly according to the placed state of the flat panel electronic device 150. As an example, as shown in FIG. 2A, the controller 130 may control the speakers 140A and 140B to play the left channel audio and the speakers 140C and 140D to play the right channel audio. In the placed state shown in FIG. 2B, the controller 130 may control speakers 140A and 140D to play the left channel audio and the speakers 140B and 140C to play the right channel audio. The controller 130 controls the plurality of the speakers 140 to play the left channel audio and the right channel audio generated by the audio generator 110 selectively according to the detecting signal, so that the first portion of the plurality of speakers 140 plays the left channel audio and the second portion of the plurality of speakers 140 plays the right channel audio. To be noted, in one embodiment, the plurality of the speakers 140 are all in operation when playing the audio. In another embodiment, one or more of the plurality of the speakers 140 may be not in work when playing the audio. For example, in the placed state shown in FIG. 2A, only the speakers 140B and 140C or the speakers 140A and 140D may be controlled to play the left channel audio and the right channel audio respectively. Naturally, all four speakers may also be in operation. According to the disclosed description, those skilled in the art can understand how to select the speakers for playing the left channel audio and the right channel audio in other arrangements. Therefore, they are no longer described in detail herein.

In one embodiment, the plurality of the speakers are configured such that multi-pairs of speakers of the plurality of speakers are symmetrically disposed at the left side and the right side of the flat panel electronic device 150 in the installed state that the audio playing apparatus 100 is installed to the flat panel electronic device 150, respectively, no matter how the flat panel electronic device 150 is placed. In the embodiment shown in FIGS. 2A-2D, two pairs of speakers are disposed at the left side and the right side respectively, no matter how the flat panel electronic device 150 is placed. In the embodiment shown in FIG. 5, two or three pairs of speakers are disposed at the left side and the right side, no matter how the flat panel electronic device 150 is placed. Thus the output power of the sound is increased and the stereophonic effect is improved in the case that the thickness of the flat panel electronic device is not increased.

Furthermore, in the preferred embodiment mentioned above, the audio playing apparatus 100 may have a plurality of playing modes, since each side has a plurality of speakers. In one embodiment, the audio playing apparatus 100 may have a power saving mode. In the power saving mode, the controller 130 may control only one pair of speakers of the multi-pairs of speakers 140 which is symmetrically disposed at the left side and right side of the flat panel electronic device 150 to play the left channel audio and the right channel audio correspondingly. Thus only one pair of speakers is chosen to play the left channel audio and the right channel audio respectively, when the external environment is quite. Thus, the power is saved.

Further, each side with a plurality of speakers may also bring the audio playing apparatus 100 with the sound effects and enhanced mode, for example, bass boost mode and/or surrounding sound enhanced mode, etc. They will be described in detail hereinafter. Naturally, the audio playing apparatus 100 may further have other modes, and they are not explained herein for the sake of simplicity.

In one embodiment, as shown in FIG. 2A, the multi-pairs of the speakers may include a first pair of speakers 140A and 140D and a second pair of speakers 140B and 140C. Accordingly, the left channel audio may include a first left channel audio and a second left channel audio, and the right channel audio may includes a first right channel audio and a second right channel audio. In one embodiment, the second left channel audio and the second right channel audio may be a component for the bass boost, so as to improve the original sound reproduction effect. In another embodiment, the second left channel audio and the second right channel audio may be a left surround channel audio and a right surround channel audio, so that the stereo effect is more realistic. In one embodiment, the first pair of speakers 140A and 140D is used for playing the first left channel audio and the first right channel audio respectively, and the second pair of speakers 140B and 140C is used for playing the second left channel audio and the second right channel audio respectively. The auditory effect is improved, since the first pair of speakers 140A and 140D and the second pair of speakers 140B and 140C can play the sound signals with suitable frequency ranges. To be noted, the first pair of speakers and the second pair of speakers should correspond to other speakers respectively, when the flat panel electronic device 150 is in other placed states.

As shown in FIGS. 2A-2D, the audio playing apparatus 100 may preferably includes four speakers 140A, 140B, 140C and 140D, and the four speakers 140A, 140B, 140C and 140D are disposed at four corners of the flat panel electronic device 150 when the audio playing apparatus 100 is installed to the flat panel electronic device 150. In this arrangement, it achieves that two pairs of speakers are disposed at the left side and the right side, respectively, no matter how the flat panel electronic device is placed. In this way, the audio playing apparatus can have a plurality of playing modes, for example, the power saving mode and the all playing mode etc. Moreover, the number of the speakers is minimized on the premise of achieving the above functions. Thus, the cost is reduced, and the speakers can be made full use.

In a preferred embodiment, as shown in FIG. 4, the audio playing apparatus 100 may include three speakers 140A, 140B and 140C which are disposed at three corners of the flat panel electronic device 150 respectively, when the audio playing apparatus 100 is installed to the flat panel electronic device 150. In this arrangement, one pair of speakers plays the left channel audio and the right channel audio correspondingly, no matter how the flat panel electronic device is placed. The listeners can experience stereo effect, and the cost is lower due to the reduced number of the speakers. Moreover, the third speaker, for example, the speaker 140A in the placed state shown in FIG. 4, can further be used for the bass boost or playing the mixture of the left channel audio and the right channel audio, so as to provide different auditory effects.

Figure 6:
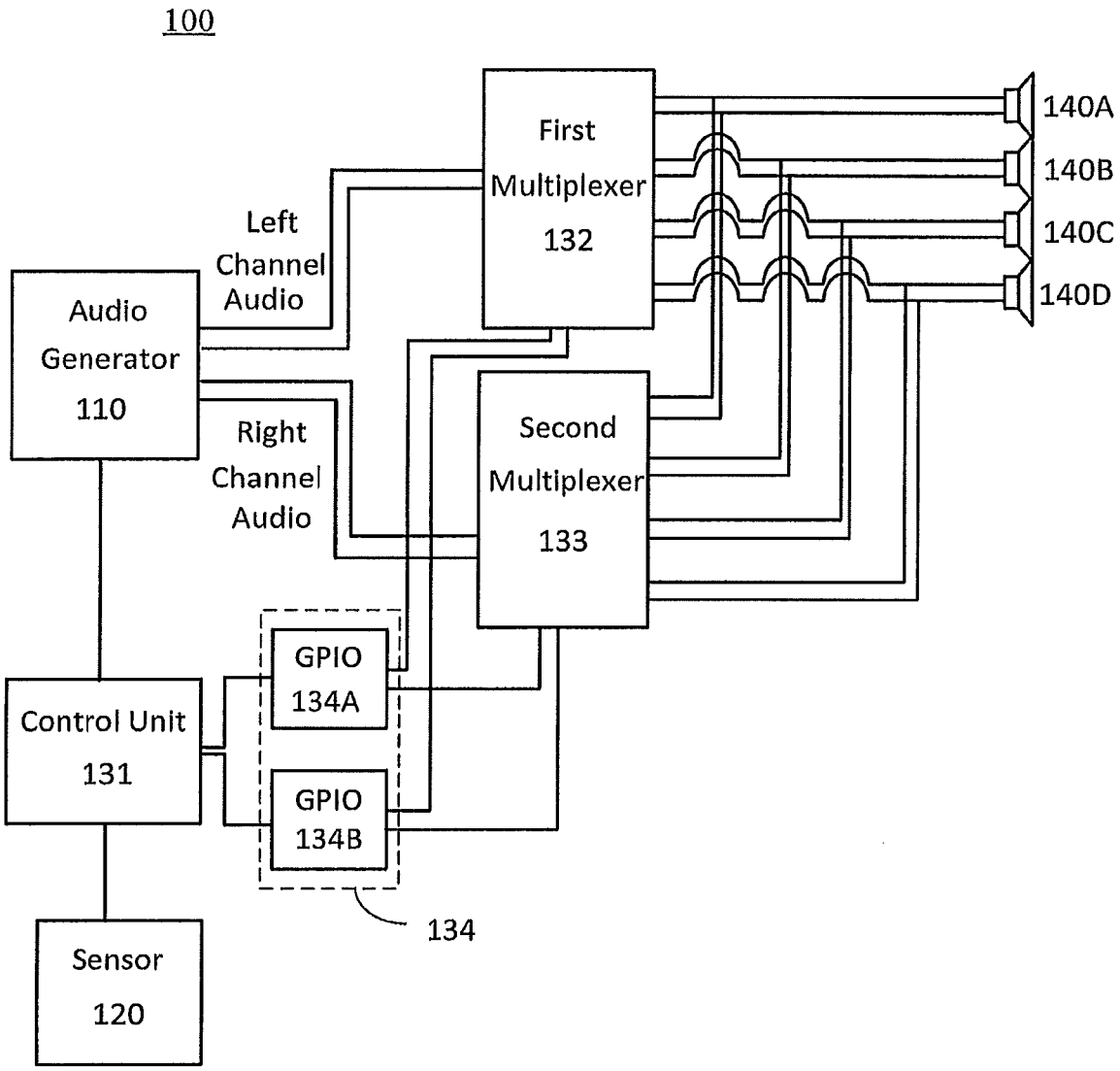
FIG. 6 is a schematic block diagram of one embodiment of an audio playing apparatus.

Following is the description of an audio playing apparatus 100 in accordance with FIG. 6. The controller 130 included in the audio playing apparatus 100 is mainly described in detail herein.

As shown in FIG. 6, the controller 130 includes a control unit 131, a first multiplexer 132 and a second multiplexer 133. An input of the first multiplexer 132 and an input of the second multiplexer 133 receive the left channel audio and the right channel audio from the audio generator 110 respectively. Outputs of the first multiplexer 132 and outputs of the second multiplexer 133 are connected to each of the plurality of the speakers 140A, 140B, 140C and 140D. The control unit 131 is operable to control the first multiplexer 132 and the second multiplexer 133 according to the detecting signal, so as to control at least one pair of speakers of the plurality of the speakers 140 to play the left channel audio and the right channel audio, correspondingly. In one embodiment, the control unit 131 may send an original audio signal in digital to the audio generator 110. The audio generator 110 receives this digital signal and converts it into an analog signal to generate the left channel audio and the right channel audio. In other embodiments, the left channel audio and the right channel audio may be directly generated by the audio generator 110 when a command is received from the control unit 130 or the user. In one embodiment, the controller 130 further includes a GPIO (generate purpose input/output) 134. The GPIO 134 may be integrated in the control unit 131. The control unit 131 controls the first multiplex 132 and the second multiplex 133 through the GPIO 134. In the case that the audio playing apparatus 100 includes four speakers 140A, 140B, 140C and 140D, the GPIO 134 may includes a first GPIO 134A and a second GPIO 134B. As an example, the control unit 131 may control the first GPIO 134A and the second GPIO 134B to output 00, 01, 10 or 11 according to the detecting signal. The first multiplex 132 may control the speaker(s) for playing the left channel audio to open and control the speaker(s) for playing the right channel audio to close according to the control signal output by the GPIO 134. The second multiplex 132 may control the speaker(s) for playing the right channel audio to open and control the speaker(s) for playing the left channel audio to close according to the control signal output by the GPIO 134. As an example, when the GPIO 134 outputs 00, the first GPIO 134A may control only the speakers 140A and 140B to open for playing the left channel audio, while the second GPIO 134B may control only the speakers 140C and 140D to open for playing the right channel audio. As an example, the control unit 131 may be a separate controller. In another embodiment, the control unit 131 may also be integrated to the SOC (System On Chip).

Figure 7:
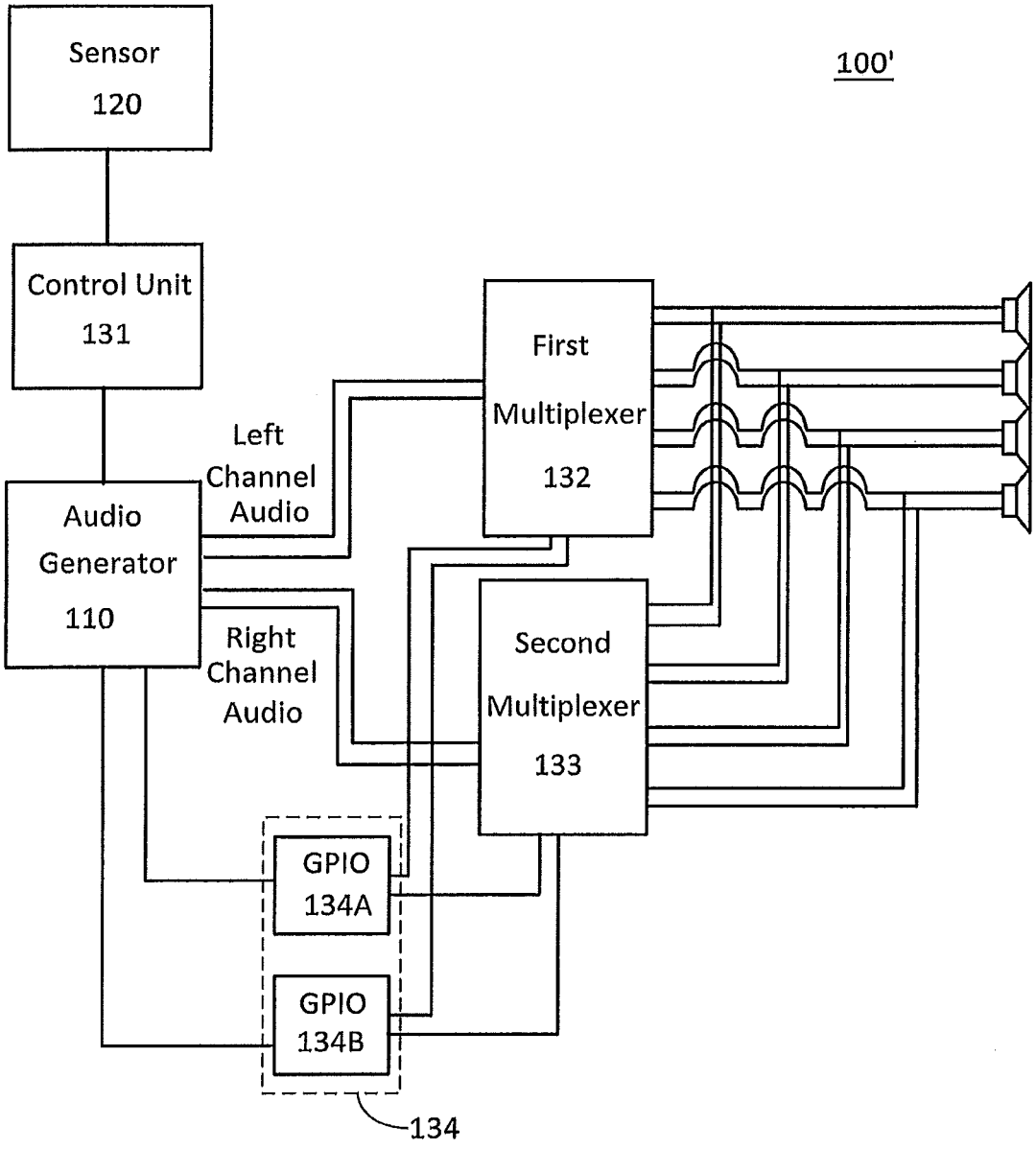
FIG. 7 is a schematic block diagram of another embodiment of an audio playing apparatus.

It can be understand that the controller 130 can also have other configurations. FIG. 7 shows a schematic block diagram of an audio playing apparatus 100' of another embodiment. The audio playing apparatus 100' is basically the same as the audio playing apparatus 100 shown in FIG. 6. The difference between them lies in that the control unit 131 generates a control signal according to the detecting signal from the sensor 120 and sends the control signal to the GPIO 134 through the audio generator 110. The GPIO 134 may be integrated in the audio generator 110. In one embodiment, the control unit 131 is integrated in the SOC and the SOC may send the control signal to the audio generator 110 by I2C/SPI.

Figure 8:
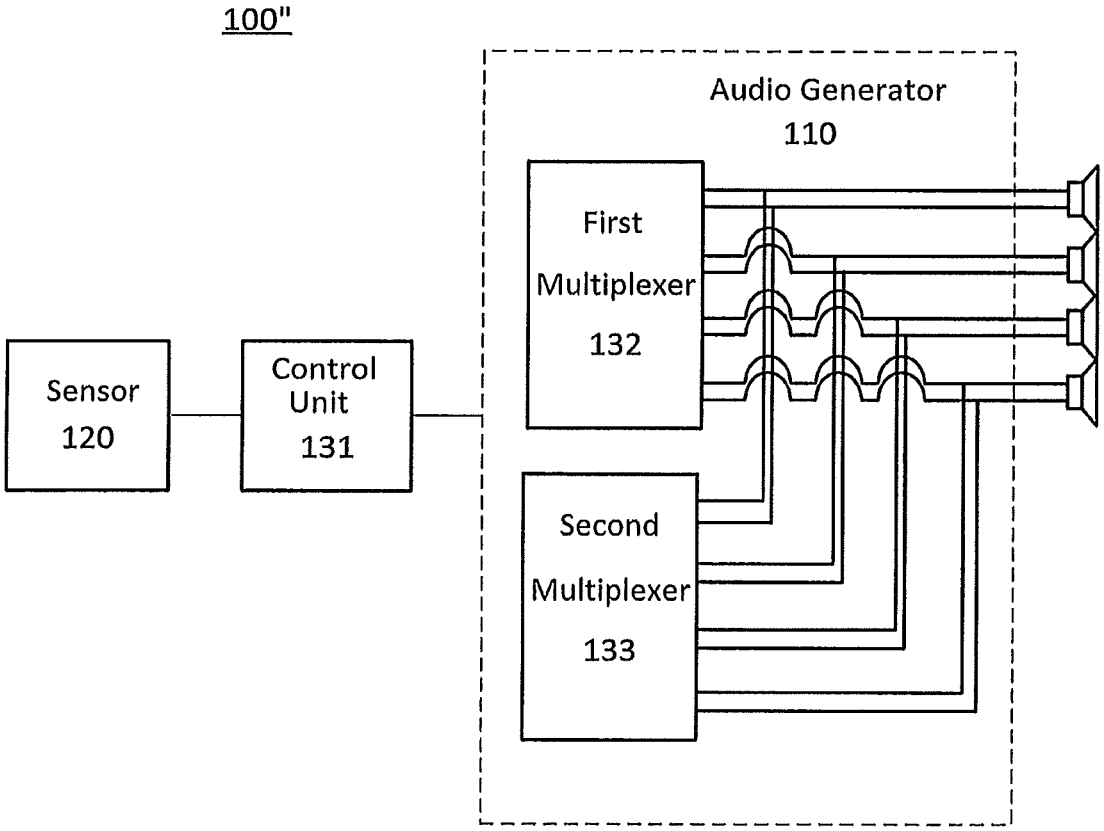
FIG. 8 is a schematic block diagram of yet embodiment of an audio playing apparatus.

A schematic block diagram of an audio playing apparatus 100" of a preferred embodiment is shown in FIG. 8. The audio playing apparatus 100" is basically the same as the audio playing apparatus 100' shown in FIG. 7. The difference between them lies in that the first multiplexer 132 and the second multiplexer 133 of the audio playing apparatus 100" shown in FIG. 8 are integrated in the audio generator 110. This arrangement is more suitable for the case that the multi-pairs of the speakers are symmetrically disposed, for example, the embodiments shown in the FIGS. 2A-2D and FIG. 5. In this case, by integrating the first multiplexer 132 and the second multiplexer 133 in the audio generator 110, the plurality of the speakers at each side may play different parts of the audio, respectively. As an example, one pair of speakers of the plurality of the speakers may play bass boost, thus, the auditory effect can be improved. In the case that the controller 131 controls the first multiplexer 132 and the second multiplexer 133 through the GPIO (not shown), the GPIO may be integrated with the audio generator 110. Furthermore, other components included by the controller 130 may also be integrated with the generator 110.

A flat panel electronic device is also provided. Referring to FIGS. 2A-2D and FIGS. 3-5, the flat panel electronic device 150 includes any audio playing apparatus mentioned above. In one embodiment, the audio playing apparatus 100 includes an audio generator 110, a plurality of speakers 140, a sensor 120 and a controller 130. Each component contained in the audio playing apparatus may refer to the description of the respective part above. Therefore, it will not be further described for the sake of simplicity.

In conclusion, the audio playing apparatus is able to play the left channel audio and the right channel audio corresponding to the left ear and the right ear respectively, according to the current placed state of the flat panel electronic device.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described to best explain the principles of the invention and its practical applications, to thereby enable others skilled in the art to best use the invention and various embodiments with various modifications as may be suited to the particular use contemplated.

Those skilled in the art to which this application relates will appreciate that other and further additions, deletions, substitutions and modifications may be made to the described embodiments.

What is claimed is:

1. An audio playing apparatus for a flat panel electronic device, comprising:

an audio generator operable to generate a left channel audio and a right channel audio;

a sensor operable to detect a placed state of the flat panel electronic device, the placed state including a portrait state and a landscape state;

a plurality of speakers configured such that at least one pair of speakers of the plurality of speakers is symmetrically disposed at a left side and a right side of the flat panel electronic device with respect to a user, irrespective of the placed state that the flat panel electronic device is placed; and a controller operable to receive a detecting signal from the sensor and control, based on the detecting signal and a playing mode of the audio playing apparatus, the plurality of speakers such that the at least one pair of speakers plays the left channel audio and the right channel audio correspondingly according to the placed state of the flat panel electronic device;

wherein the audio playing apparatus has a power saving mode, and the controller is operable to control only one pair of speakers of the plurality of speakers to play the left channel audio and the right channel audio correspondingly under the power saving mode.

2. The audio playing apparatus according to claim 1, wherein the plurality of the speakers are configured such that multi-pairs of speakers of the plurality of speakers are symmetrically disposed at the left side and the right side of the flat panel electronic device, respectively, irrespective of the placed state that the flat panel electronic device is placed.

3. The audio playing apparatus according to claim 1, wherein at least one speaker of the plurality of speakers provides different auditory effects to the left and right channel audios.

4. The audio playing apparatus according to claim 2, wherein the multi-pairs of speakers comprise a first pair of speakers and a second pair of speakers, wherein the left channel audio comprises a first left channel audio and a second left channel audio and the right channel audio comprises a first right channel audio and a second right channel audio, and wherein the first pair of speakers are used for playing the first left channel audio and the first right channel audio correspondingly and the second pair of speakers are used for playing the second left channel audio and the second right channel audio correspondingly.

5. The audio playing apparatus according to claim 2, wherein the audio playing apparatus comprises four speakers which are disposed at four corners of the flat panel electronic device in the installed state, respectively.

6. The audio playing apparatus according to claim 1, wherein the controller comprises:

a first multiplexer and a second multiplexer, wherein an input of the first multiplexer and an input of the second multiplexer receive the left channel audio and the right channel audio respectively and outputs of the first multiplexer and outputs of the second multiplexer are connected to each of the plurality of the speakers; and a control unit operable to control the first multiplexer and the second multiplexer according to the detecting signal.

7. The audio playing apparatus according to claim 6, wherein the controller further comprises a GPIO (general purpose input and output) through which the control unit controls the first multiplexer and the second multiplexer.

8. The audio playing apparatus according to claim 6, wherein the first multiplexer and the second multiplexer are integrated in the audio generator.

9. The audio playing apparatus according to claim 1, wherein the audio playing apparatus comprises three speakers which are disposed at three corners of the flat panel electronic device in the installed state, respectively.

10. The audio playing apparatus according to claim 1, wherein the sensor is selected from the group consisting of:

a 9-axis sensor, a 6-axis sensor, a gravity sensor, a magnetic sensor, and a gyro.

11. A flat panel electronic device, having an audio playing apparatus, wherein the audio playing apparatus comprises:

an audio generator operable to generate a left channel audio and a right channel audio;

a sensor operable to detect a placed state of the flat panel electronic device, the placed state including a portrait state and a landscape state;

a plurality of speakers configured such that at least one pair of speakers of the plurality of speakers is symmetrically disposed at a left side and a right side of the flat panel electronic device with respect to a user, irrespective of the placed state that the flat panel electronic device is placed; and a controller operable to receive a detecting signal from the sensor and control, based on the detecting signal and a playing mode of the audio playing apparatus, the plurality of speakers such that the at least one pair of speakers plays the left channel audio and the right channel audio correspondingly according to the placed state of the flat panel electronic device;

wherein the audio playing apparatus has a power saving mode, and the controller is operable to control only one pair of speakers of the plurality of speakers to play the left channel audio and the right channel audio correspondingly under the power saving mode.

12. The flat panel electronic device according to claim 11, wherein the plurality of the speakers are configured such that multi-pairs of speakers of the plurality of the speakers are symmetrically disposed at the left side and the right side of the flat panel electronic device, respectively, irrespective of the placed state that the flat panel electronic device is placed.

13. The flat panel electronic device according to claim 11, wherein at least one speaker of the plurality of speakers provides different auditory effects to the left and right channel audios.

14. The flat panel electronic device according to claim 12, wherein the multi-pairs of speakers comprise a first pair of speakers and a second pair of speakers, wherein the left channel audio comprises a first left channel audio and a second left channel audio and the right channel audio comprises a first right channel audio and a second right channel audio, and wherein the first pair of speakers are used for playing the first left channel audio and the first right channel audio correspondingly and the second pair of speakers are used for playing the second left channel audio and the second right channel audio correspondingly.

15. The flat panel electronic device according to claim 12, wherein the audio playing apparatus comprises four speakers which are disposed at four corners of the flat panel electronic device respectively.

16. The flat panel electronic device according to claim 11, wherein the controller comprises:

a first multiplexer and a second multiplexer, wherein an input of the first multiplexer and an input of the second multiplexer receive the left channel audio and the right channel audio respectively and outputs of the first multiplexer and outputs of the second multiplexer are connected to each of the plurality of the speakers; and a control unit operable to control the first multiplexer and the second multiplexer according to the detecting signal.

17. The flat panel electronic device according to claim 16, wherein the controller further comprises a GPIO through which the control unit controls the first multiplexer and the second multiplexer.

18. The flat panel electronic device according to claim 16, wherein the first multiplexer and the second multiplexer are integrated in the audio generator.

19. The flat panel electronic device according to claim 11, wherein the audio playing apparatus comprises three speakers which are disposed at three corners of the flat panel electronic device respectively.

20. The flat panel electronic device according to claim 11, wherein the sensor is selected from the group consisting of:

a 9-axis sensor, a 6-axis sensor, a gravity sensor, a magnetic sensor, and a gyro.

* * * * *